United States Patent [19]

Kee

[11] Patent Number: 4,940,406

[45] Date of Patent: Jul. 10, 1990

[54] INCOMPLETE COMBUSTION PREVENTING GAS BURNER

[75] Inventor: Heu-Tae Kee, Seoul, Rep. of Korea

[73] Assignee: SamSung Electronics Co., Ltd., Kyung Ki-Do, Rep. of Korea

[21] Appl. No.: 389,811

[22] Filed: Aug. 4, 1989

[30] Foreign Application Priority Data

Dec. 14, 1988 [KR] Rep. of Korea ..... 88 20625

[51] Int. Cl.[5] ..... F23N 5/00

[52] U.S. Cl. ..... 431/22; 431/80; 431/328

[58] Field of Search ..... 431/22, 79, 80, 328, 431/354

[56] References Cited

U.S. PATENT DOCUMENTS

| | | | |
|---|---|---|---|
| 624,071 | 5/1899 | McCartney | 431/328 |
| 2,122,132 | 6/1938 | Docking | 431/328 |
| 3,295,585 | 1/1967 | Kovach et al. | 431/22 |
| 3,321,001 | 5/1967 | Vezzoli | 431/22 |

*Primary Examiner*—Carroll B. Dority

*Attorney, Agent, or Firm*—Robert E. Bushnell

[57] ABSTRACT

An improved incomplete combustion preventing gas burner is disclosed, the improvement comprising: a venturi having a narrow passage and installed downstream of a mixing room in such a manner that the mixed combustible gas from the mixing room should be spouted with a high velocity through the flame holes, and a V shaped guide portion provided on the mixed combustible gas path leading from the mixing room to the flame holes. Thus, if an unstable mixing ratio occurs in the mixing room to cause an incomplete combustion, a lifting phenomenon for the flame is induced through the utilization of the high velocity of the mixed combustible gas, so that the thermal interaction between the flame 5 and the thermo-electric couple 7 should be halted, and that the combustible gas supply should be blocked, thereby extinguishing the flame.

14 Claims, 2 Drawing Sheets

INCOMPLETE COMBUSTION PREVENTING GAS BURNER

FIELD OF THE INVENTION

The present invention relates to a gas burner in which the gas cock of the burner is opened/closed in accordance with the electromotive force produced from a thermo electric couple, and particularly, to an incomplete combustion preventing burner in which the mixing room for mixing the combustible gas and the air is provided with a venturi for increasing the jet velocity, so that, if incomplete combustions occur at the flame hole due to the deficiency of oxygen, then the flame is extinguished by causing a lifting phenomenon in the flame.

BACKGROUND OF THE INVENTION

Generally, gas burners are constituted such that the combustible gas introduced a gas supply nozzle and the air introduced through an air duct are mixed together in a mixing room of the burner, and the mixed air-gas is spouted through a plurality of flame holes formed at upper positions of the burner, thus flames being produced by igniting the spouting air-gas mixture.

However, in such conventional gas burners, the mixing room takes the form of a tube, and therefore, the gas pressure spouting through the flame hole becomes very low. Therefore, this brings the result that the air-gas mixing ratio becomes very low, or oxygen deficiency is caused. This in turn causes incomplete combustions at the flame hole, and such incomplete combustions remain indefinitely without being extinguished.

Such incomplete combustions can pollute the room air due to the incompletely burnt exhaustion gas, and especially, in the case where a gas boiler is installed in the rest room to supply hot water to the bath room, an oxygen depletion and a suffocating accident can occur due to the fact that the oxygen in the room is continuously consumed by the burner of the boiler.

SUMMARY OF THE INVENTION

The present invention is intended to overcome the disadvantages of the conventional burners.

Therefore, it is the object of the present invention to provide a gas burner in which an incomplete combustion flame is extinguished upon occurring of it by positively inducing a flame lifting phenomenon.

In achieving the above object, the device of the present invention is constituted such that a gently curved venturi is provided at a certain position of the mixing room of the gas burner by means of a press forming, in such a manner that the said venturi should provide a narrow passage hole, and that the mixed air-gas should be spouted through the flame hole with a certain high velocity.

BRIEF DESCRIPTION OF THE DRAWINGS

The above object and other advantages of the present invention will become more apparent by describing the preferred embodiment of the present invention with reference to the attached drawings in which.

FIGS. 2A and 2B are sectional views taken along the line A—A of FIG. 1 in which;

FIG. 2A shows the flames of a normal combustion; and FIG. 2B shows the flames of an incomplete combustion.

DESCRIPTION OF THE PREFERRED EMBODIMENT

Figure 1:
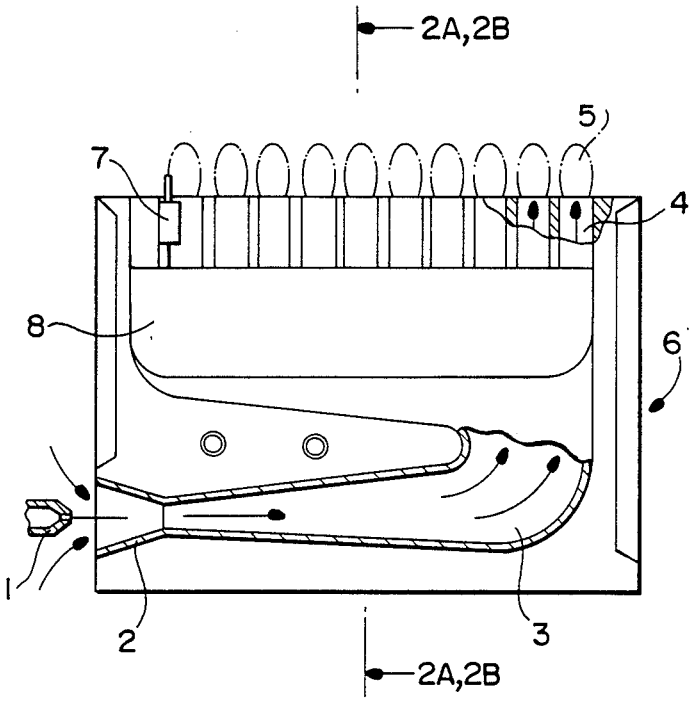
FIG. 1 is a frontal view of a gas burner adopting the device of the present invention.

FIG. 1 illustrates a gas burner 6 in which the combustible gas supplied through a gas supply nozzle 1 and the air supplied through an air duct 2 are mixed together in a mixing room 3, and the mixed air-gas is spouted through a plurality of flame holes 4 to produce flames 5 by igniting the mixed air-gas.

Further, the burner 6 is also provided with a thermoelectric couple 7 for opening-closing a combustible gas supply cock(not shown) in accordance with the degree of the generation of the thermo electromotive force induced by the flame 5 of the flame hole 4. At a certain position of the mixing room 3 of the burner, a gently curved venturi 8 is provided by means of a press forming, and, along the paths leading from the venturi 8 to the respective flame holes 4, a shaped guide portion 9 is provided so that the combustible mixed gas spouting from the flame holes 4 should have a certain high velocity. The device of the present invention constituted as above will now be described as to its function and effect.

As described above, a gently curved venturi 8 is provided at a certain position of the mixing room 3 by means of a press forming as shown in FIGS. 1 and 2, and a V shaped guide portion 9 is provided on the combustible mixed gas supply paths leading from the said mixing room 3 to the flame holes 4, in such a manner that the paths should have a uniform feature. Thus the air-gas mixture from the mixing room 3 gains a high velocity during the transfer through the narrow passage of the venturi 8, and is discharged with such a high velocity.

Figure 2A:
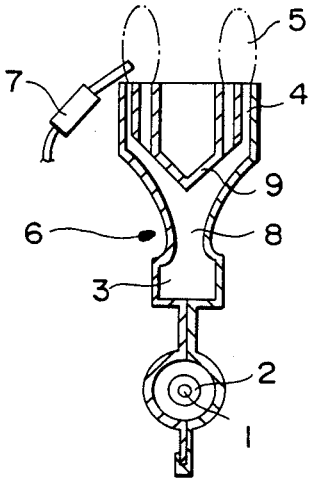
Figure 2B:
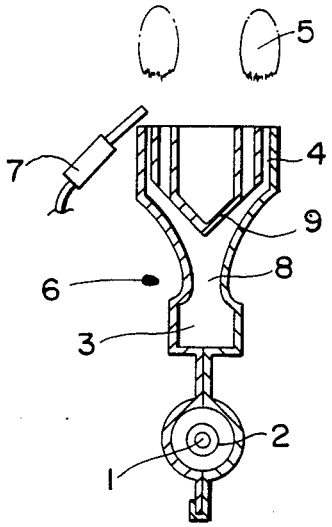

Accordingly, if an incomplete combustion occurs due to the deficiency of oxygen in the introduced air, a positive lifting phenomenon will occur to the flame 5 as shown in FIG. 2B due to the high velocity of the spouting mixed combustible gas.

Therefore, in such a case, the flame 5 is departed from the thermo-electric couple 7, with the result that there exists no longer a substantial thermal interaction between the flame 5 and the thermo-electric couple 7. This will cause a decrease in the electromotive force produced from the thermo-electric couple 7, and accordingly, the combustible gas supplied through the gas supply nozzle 1 will be blocked, thereby extinguishing the flame 5.

Meanwhile, as long as the mixing ratio between the combustible gas and the air is stably maintained, the flame 5 produced from the flame hole 4 will not be departed from the flame hole 4 as shown in FIG. 2A. Therefore, the thermal interaction between the flame 5 and the thermo-electric couple 7 will be continued, and accordingly, the mixed combustible gas will be continuously supplied through the gas supply nozzle 1, thereby maintaining the normal combustion.

That is, in the case where the oxygen content in the air falls below the tolerable level, and this, if an unstable mixing ratio occurs in the mixing room 3, a lifting phenomenon for the flame 5 is induced through the utilization of the high velocity of the spouting of the mixed combustible gas, so that the thermal interaction between the flame 5 and the thermo-electric couple 7 should be halted, and that the combustible gas supply should be blocked, thereby extingushing the flame.

Therefore, the device of the present invention contributes to the stable combustion of fuel, increases the thermal efficiency of fuel, and prevent dangerous accidents attributable to incomplete combustions of gas.

What is claimed is:

1. An incomplete combustion preventing gas burner which includes a mixing room for mixing air and gas, flame holes for spouting the air-gas mixture, and a thermo-electric couple installed in the vicinity of the said flame holes in order to open/close a combustible gas supply cock in accordance with the thermal interactions between the said flame and the said thermo-electric couple, the improvement comprising:

means forming a venturi located between said mixing room and said flame holes; and a V-shaped guide portion extending into said venturi means and further restricting the flow of air and gas to said flame holes so that a mixture of air and gas is spouted from said flame holes at high velocity.

2. An incomplete combustion preventing gas burner, comprising:

a mixing chamber for forming an air and gas mixture;

a plurality of flame aperture means for forming a plurality of spouts of the air and gas mixture;

means installed in the vicinity of the said aperture means for regulating a combustible gas supply cock in accordance with thermal characteristics in the vicinity of said aperture means;

means forming a venturi having a passage narrower than provided by said mixing chamber, disposed between said mixing chamber and aperture means; and a V-shaped guide provided on the path of the air and gas mixture leading from the mixing room to the flame holes, said guide having an apex protruding into said venturi to diminish cross-sectional area of said path as said path progresses from said apex toward said aperture means.

3. A gas burner, comprising:

means forming a mixing chamber providing an air and gas mixture;

means forming a plurality of apertures, for exhausting the air and gas mixture traveling along a path from the mixing chamber, in a distributed array of flames when the air and gas mixture is ignited;

means disposed for detection of thermal characteristics of a flame adjoining said aperture forming means;

venturi means for defining said path between said chamber forming means and said aperture forming means, with boundaries of said path exhibiting an increasing width as a function of distance along said path from said mixing chamber; and said path including guide means disposed between said aperture forming means and said venturi means, for restricting the volume of said path as a function of distance along said path from said mixing chamber.

4. The gas burner of claim 3, further comprised of said venturi means defining said boundaries to exhibit an increasing rate of increase in said increasing width.

5. The gas burner of claim 3, further composed of said guide means having an apex protruding into said venturi means and defining said path between said apex and aperture forming means.

6. The gas burner of claim 3, further comprised of said guide means having an apex protruding into said venturi means and dividing said path between said apex and different apertures of said aperture forming means.

7. The gas burner of claim 3, further comprised of said venturi means having an interior side wall defining the path, said interior side wall exhibiting a curvature having a radius increasing in value along the path as a function of distance along the path from said mixing volume.

8. The bas burner of claim 4, further comprised of said venturi having an interior side wall defining the path, said interior side wall exhibiting a curvature having a radius increasing in value along the path as a function of distance along the path from said mixing volume.

9. The gas burner of claim 5, further comprised of said apex being disposed relative to said venturi to diminish cross-sectional area of said path as said path progresses from said apex toward said aperture means.

10. The gas burner of claim 4, further comprised of said venturi having an interior side wall defining the path, said interior side wall exhibiting a curvature having a radius increasing in value along the path as a function of distance along the path from said mixing volume.

11. The gas burner of claim 3, further comprised of said thermal characteristics detection means being disposed to engage flames of said air and gas mixture adjoining said aperture means.

12. The gas burner of claim 2, further comprised of said venturi having an interior side wall defining the path, said interior side wall exhibiting a curvature having a radius increasing in value along the path as a function of distance along the path from said mixing volume.

13. The gas burner of claim 2, further comprised of said regulating means being disposed to engage flames of said air and gas mixture adjoining said aperture means.

14. The gas burner of claim 12, further comprised of said regulating means being disposed to engage flames of said air and gas mixture adjoining said aperture means.

* * * * *